United States Patent [19]

Harris

[11] 4,246,967

[45] Jan. 27, 1981

[54] CEMENTING HEAD APPARATUS AND METHOD OF OPERATION

[75] Inventor: Monty E. Harris, Cleveland, Okla.

[73] Assignee: The Dow Chemical Company, Midland, Mich.

[21] Appl. No.: 61,090

[22] Filed: Jul. 26, 1979

[51] Int. Cl.[3] ..... E21B 33/05

[52] U.S. Cl. ..... 166/291; 15/104.06 A; 166/75 R; 166/153

[58] Field of Search ..... 166/291, 285, 153, 156, 166/75 R, 84, 85, 88, 90

[56] References Cited

U.S. PATENT DOCUMENTS

| | | | |
|---|---|---|---|
| 1,011,484 | 12/1911 | Perkins et al. | 166/291 |
| 2,164,190 | 6/1939 | Klomp | 166/156 |
| 2,481,422 | 9/1949 | Haynes et al. | 166/156 |
| 2,664,163 | 12/1953 | Schnitter | 166/156 |
| 3,076,509 | 2/1963 | Burns et al. | 15/104.06 A |
| 3,216,500 | 11/1965 | Diehl | 15/104.06 A X |
| 3,435,895 | 4/1969 | Lee | 166/75 |
| 3,444,928 | 5/1969 | Pitts | 15/104.06 A X |

FOREIGN PATENT DOCUMENTS

| | | | |
|---|---|---|---|
| 1419285 | 12/1975 | United Kingdom | 166/285 |

*Primary Examiner*—Stephen J. Novosad

[57] ABSTRACT

A cementing head apparatus is disclosed, for injecting a cementing plug into a well casing. The basic apparatus is made up of a head unit, manifold unit, and a tubular mandrel slidable within the manifold unit. Prior to injecting cement into the well casing, the cementing plug is mounted in the head unit and held in place by a shearable O-ring. During the cementing operation, part of the slurry stream flows through the head unit below the cementing plug, and part of the slurry collects in a "head" space above the plug. This arrangement provides an equal pressure force on both sides of the plug, to prevent premature injection of the plug into the well casing. When the desired amount of cement has been pumped, the mandrel is moved to a position which cuts off the cement flow and diverts another fluid only into the space above the plug. The resulting pressure above the plug shears the O-ring and allows the plug to follow the slurry down the well casing.

8 Claims, 3 Drawing Figures

CEMENTING HEAD APPARATUS AND METHOD OF OPERATION

BACKGROUND OF THE INVENTION

The invention relates broadly to an apparatus and method for cementing of a well casing in a borehole. More specifically, the invention covers a cementing head for injecting a cementing plug into the well casing.

In a typical well cementing operation, a bottom cementing plug is introduced into the well casing ahead of the cement slurry. After the desired amount of cement slurry has been injected into the well casing, another plug, usually called a top plug, follows immediately behind the slurry column as it travels down the well casing. The function of the top and bottom plugs is to separate the cement slurry column from drilling muds and other fluids which can contaminate the slurry. Drilling mud or some other fluid is then pumped into the casing behind the top plug to push the cement slurry through the casing and up into the annulus between the casing and the borehole.

The cementing heads presently in use for injecting cementing plugs into a well casing are not entirely satisfactory. A primary reason is that most of the cementing heads now in use require that an operator on the rig floor inject the plug into the well casing, at the appropriate time, using a manual procedure. Because these cementing heads do not have a positive means for indicating that the plug has been injected into the casing, it can create a very hazardous situation for the operator if the plug should hang up in the head itself, or in the well casing. In addition to being unsafe, the situation described above can result in a substantial waste of material (cement slurry), and a waste of time required to shut down the cementing operation and clean up the equipment.

SUMMARY OF THE INVENTION

The cementing head apparatus of this invention is used for injecting a cementing plug into a well casing. The basic apparatus is made up of a head unit and a manifold unit. The head unit includes a plug housing with a baffle member secured inside the housing. A cementing plug assembly is mounted in the baffle and retained by a shear means. The plug housing has two fluid inlet ports; one port is located above the baffle, and the other one below the cementing plug assembly.

The plug housing also includes a coupling means specifically designed for connecting the well casing into the head unit. The manifold unit includes an upper manifold housing and a lower manifold housing coupled into the upper housing. The lower manifold housing is also adapted for connecting into a cementing apparatus. There are two fluid outlet ports in the upper manifold housing. One outlet port is adapted for coupling into the inlet port above the baffle, and the other outlet port is designed for coupling into the inlet port located below the cementing plug assembly.

The manifold unit also includes a tubular mandrel which has an outside shoulder. The mandrel is positioned with a slide fit inside the upper and lower manifold housing. The mandrel can slide upwardly to close off the inlet port located below the cementing plug assembly, and downwardly to a position which allows fluid to enter this same inlet port. The inside diameter toward the top part of the lower manifold housing is larger than the outside diameter of the mandrel. The space thus provided between the mandrel and the lower housing defines an annular chamber. This chamber has two inlet ports which connect into a source of fluid, the fluid providing a means for moving the mandrel up and down to open or close the inlet port described above.

DESCRIPTION OF PREFERRED EMBODIMENTS

Figure 1:
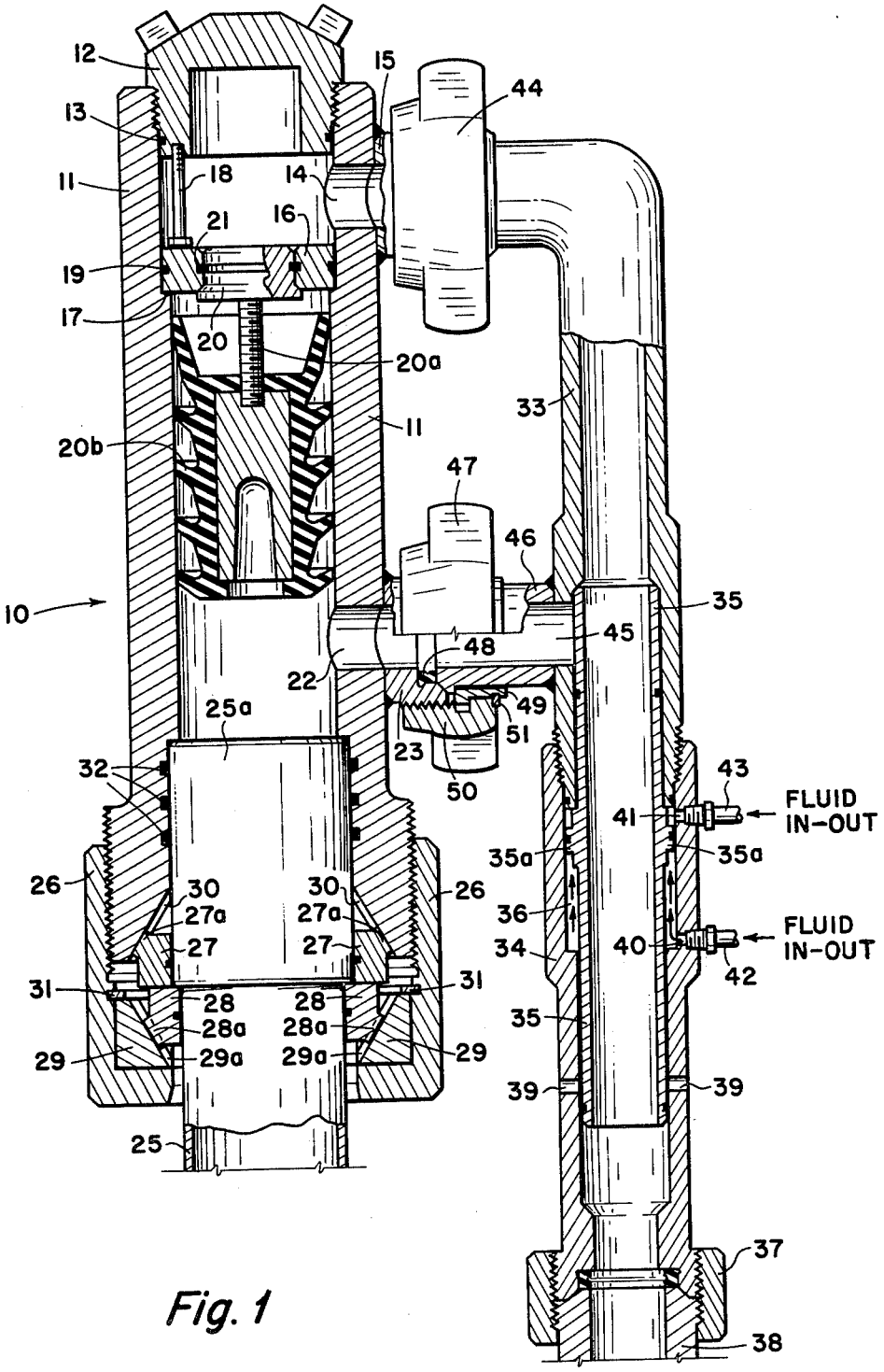
FIG. 1 is a front elevation view, mostly in section, of a cementing head apparatus according to this invention.

In the drawings, referring to FIG. 1, the cementing head of this invention is indicated generally by the numeral 10. The basic structure of this apparatus is made up of a head unit and a manifold unit. The head unit includes a plug housing 11, which is closed at the top by a threaded cap 12. In closed position, cap 12 is sealed against housing 11 by an O-ring 13.

Housing 11 has a fluid inlet port 14 in one side of the housing, the port being located immediately below the cap 12. A nipple connection 15 is welded to the outer wall surface of housing 11, so that it lines up with the inlet port 14. Nipple 15 is threaded at its outer end, to accept a union coupling (the coupling is described later). Inside the housing 11 is a baffle plate 16, which seats crosswise in the housing immediately below the inlet port 14. The baffle plate 16 seats on a narrow shoulder 17 in housing 11. The baffle plate 16 is held down against the shoulder 17 by at least two hold down studs 18, which thread into cap 12. Only one of the hold down studs 18 is shown in the drawing.

An O-ring 19 provides a fluid tight seal between the baffle plate 16 and housing 11. The baffle plate 16 has a central opening in which a cementing plug assembly is mounted. The top part of the cementing plug assembly is a cap 20, which includes a threaded stem **20*a*. The bottom part of the cementing plug assembly is the cementing plug itself, indicated at 20*b*. The stem 20*a* on cap 20 threads down into the cementing plug 20*b*. The cap and stem are fabricated of a material which can be drilled out of a well casing, such as aluminum, or certain plastic resin compositions. An O-ring 21 provides a means for mounting the cap 20 in the center opening of baffle plate 16. The O-ring 21 also provides a shearable connection which allows the plug 20*b* to break loose from baffle 16** during the cementing operation. The shearing sequence is explained in more detail later.

A second fluid inlet port 22 is located in the housing 11 below the cementing plug **20*b*. In addition, a second nipple connection 23 is welded onto the outer wall surface of housing 11, so that the nipple lines up with port 22. The nipple 23 has external threads for engagement with a union coupling 47. The bottom end of plug housing 11 has a coupling means specifically designed for connecting into the top end of the well casing 25. The top section of each well casing usually includes a coupling which is threaded over the top end of the casing section, for connection into the housing 11. Some casing sections are equipped with a long coupling 25***a*; and other sections will have a short coupling 25*b* at the top end.

The coupling structure for connecting into a long coupling 25*a* is illustrated in FIG. 1. The several parts of the connecting structure include a make-up cap 26, an upper wedge ring 27, lower wedge ring 28, and a retainer member 29. When the long coupling connection is made, a boss member 27*a* on ring 27 rides in an inclined slot 30 at the bottom end of plug housing 11. This arrangement allows the front face of ring 27 to wedge against the long coupling 25*a*. Wedge ring 27 also has a retainer spring (not numbered), which seats in the wedge ring and encloses the long coupling 25*a*.

The lower wedge ring 28 also includes a boss member 28*a*. This boss member rides in an inclined slot 29*a* in the retainer member 29. When cap 26 is threaded onto housing 11, the top face of ring 28 wedges against the bottom face of ring 27 and also against the lip of coupling 25*a*. The wedge ring 28 also has a retainer spring (not numbered) seated within the wedge ring and enclosing the long coupling 25*a*. In addition, a flat ring 31 is seated in a groove in cap 26. When the connection is made, ring 31 bears against the top face of the retainer member 29, thus providing a hold down means for the retainer member. A set of seals 32 provide a fluid-tight seal between the lower end of housing 11 and the long coupling 25*a*.

Figure 3:
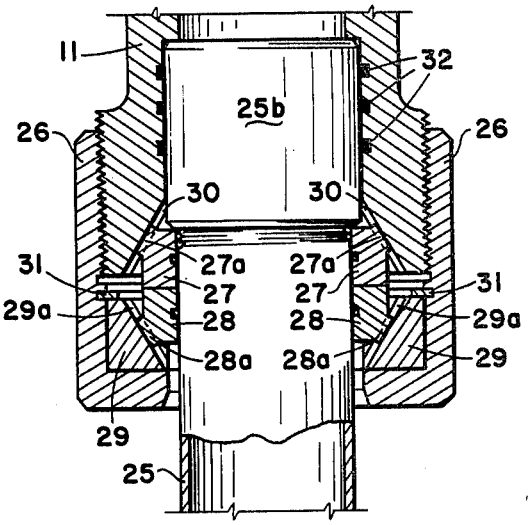
FIG. 3 is another partial detail view of the cementing head apparatus of FIG. 1. This Figure illustrates an arrangement for connecting the cementing head unit onto a well casing section which has a short coupling.

The coupling arrangement for connecting into a well casing having a short coupling 25*b* is illustrated in FIG. 3. As shown in FIG. 3, this coupling arrangement utilizes the same parts which are used in making the connection into the long coupling 25*a*. However, because the coupling 25*b* has a shorter length than the long coupling, the actual arrangement of the parts in each of the connecting structures is slightly different. For example, as shown in FIG. 3, when cap 26 is threaded onto housing 11, for the short coupling connection, the top face of ring 27 wedges against the lip of coupling 25*b*. At the same time, the top face of ring 28 pushes flat against the bottom face of ring 27, and the front face of both wedge rings is urged against the well casing 25.

Basic parts of the manifold unit include an upper manifold housing 33, a lower manifold housing 34, and a tubular mandrel 35. The mandrel also has a shoulder 35*a*, which is defined on the outer wall surface of the mandrel. The top end of lower housing 34 threads into the bottom end of the upper housing 33. Mandrel 35 is fitted inside of housings 33 and 34, with a slide fit to enable it to move up and down within the housings. Near the top end of housing 34 an annular space 36 is defined between the inner wall surface of the housing and the outer wall surface of mandrel 35. This annular space 36 provides a chamber for receiving and directing a fluid against the mandrel shoulder 35*a*. This sequence is explained in more detail later.

A fluid inlet line 38 is connected by a coupling 37 into the bottom end of the manifold housing 34. The opposite end of line 38, not shown, can be connected into a cementing pump, or other apparatus, for delivering cement slurry or some other fluid into the manifold unit. The cementing pumper and other fluid dispensing apparatus are not shown in the drawing. At least two openings 39 are located in housing 34 slightly above the bottom end of the housing. These small openings provide sight ports which enable the operator to see an indicater mark (not shown) which is painted or stamped on the outer wall surface of the mandrel. This is to provide a means for the operator to determine whether the mandrel is in its open or closed position.

At the bottom of chamber 36, the chamber is in direct comunication with a fluid inlet port 40, which extends through the wall of housing 34. A similar fluid inlet port 41, extending through the wall of housing 34, is in direct communication with the top end of chamber 36. A hydraulic fluid line 42 is connected by an appropriate fitting into the inlet port 40. A second hydraulic fluid line 43 is also connected by a fitting into the inlet port 41. At its top end the upper manifold housing 33 provides a fluid outlet port which communicates with the fluid inlet port 14 in plug housing 11.

In the actual connecting structure, the top end of housing 33 is coupled into a nipple connection 15 by a union coupling 44. Because the union coupling 44 is shown in full, rather than in section, the several parts of the connecting structure are not illustrated in FIG. 1. Housing 33 includes a second fluid outlet port 45, which is positioned in the left side of the housing slightly above the lower end. A nipple connection 46 is welded to the outer wall surface ofhousing 33, such that the nipple is in direct alignment with port 45.

A second union coupling 47 connects the nipple 46 to nipple 23, to provide communication between the outlet port 45 in the manifold unit and the inlet port 22 in the head unit. In this connecting structure the fluid seal ring 48 (hard rubber composition) is compressed between the end of nipple 46 and nipple 23. Behind this seal ring is a backing ring 49, which is held against a shoulder on nipple 46 by an outer coupling member 50, which threads over the nipple 23. Ring 49 and the coupling member 50 are tied together by a retainer ring 51. Several O-rings (not numbered) are fitted around the mandrel 35 to provide a fluid tight seal between the mandrel and the upper and lower manifold housings.

OPERATION

The invention can be illustrated by describing a typical cementing operation using the cementing head apparatus described herein. At the start of the operation, the cementing plug 20*b* is "loaded" into the plug housing 11. This is done by mounting cap 20 in the baffle plate 16 and securing the cap to the plate with the shearable O-ring 21. The head unit is then secured to the top coupling (long coupling 25*a*, or short coupling 25*b*) of the well casing 25. The fluid inlet line 38 is connected by coupling 37 into the lower manifold housing 34. At the opposite end, line 38 is connected into a cementing pumper.

Figure 2:
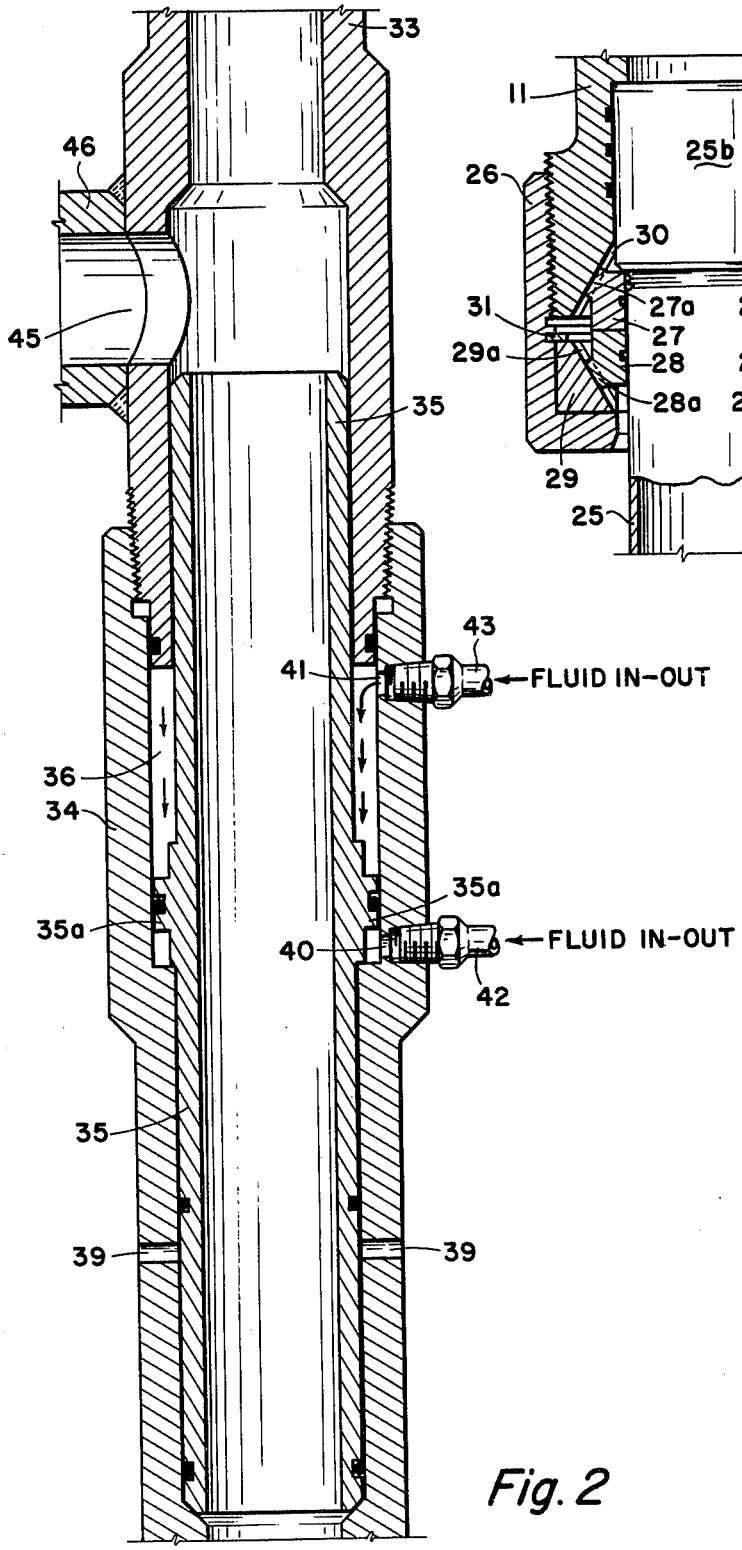
FIG. 2 is a partial detail view of the cementing head apparatus of FIG. 1. This Figure illustrates a mandrel in the cementing head, when the mandrel is in its open position.

Before the cement slurry is pumped into the well casing 25, the mandrel 35 is in its "open" position. In the open position, which is illustrated in FIG. 2, the mandrel rests at its lowest position within the manifold housings 33 and 34. When the mandrel is at this point, the top end of the mandrel lies slightly below the outlet port 45, so that the port is completely open. The cement slurry is then pumped through the cementing head 10 and into the well casing 25. With the outlet port 45 being open, most of the cement slurry will flow through the outlet port 45 and the inlet port 22 and down into the well casing 25. However, part of the cement slurry stream will pass upwardly through the manifold housing 33 and through inlet port 14. The result is a build up of the slurry in the "head space" defined in housing 11 above the baffle plate 16 and cap 20.

During the pumping operation, the force exerted by the cement slurry will be the same both above and below the cementing plug assembly. Because the slurry pressure is in balance on both sides of the cementing plug assembly, the cap 20 will remain secured to the baffle plate 16 by O-ring 21. The objective of this design feature is to prevent the cementing plug 20*b* from being pushed down the well casing prematurely.

After the desired amount of cement slurry has been pumped into the well casing, the operator cuts off the slurry flow from the pumper. At the same time he switches into a hydraulic fluid unit (not shown), which is connected into chamber 36 by the fluid inlet lines 42 and 43. The next step is to open a valve (not shown) which controls flow through line 42. This allows hydraulic fluid to enter chamber 36 through the lower inlet port 40, and push upwardly against the bottom face of the mandrel shoulder 35*a*. The fluid pressure applied is high enough to move the mandrel upwardly far enough to close off the outlet port 45. The mandrel is now in closed position, as illustrated in FIG. 1. With the mandrel in closed position, the operator switches into a fluid dispensing apparatus which is connected into the inlet line 38. This allows a fluid to flow through manifold housing 33 and inlet port 14 and into the head space above the cementing plug assemby.

Pumping of this fluid is continued until the fluid pressure is high enough to rupture (shear) the O-ring 21. When the O-ring shears loose from baffle plate 16, the cap 20 and cementing plug 20*b* will follow the cement slurry down well casing 25. A pressure gauge on the fluid dispensing apparatus enables the operator to observe the amount of fluid pressure exerted against the cementing plug assembly. When the O-ring 21 shears loose from baffle plate 16, there will be an immediate pressure drop on the gauge. This gives the operator a positive indication that the cementing plug has followed the slurry into the well casing.

If the cementing plug 20*b* should get hung up in the housing 11, or down in the well casing 25, the gauge will immediately indicate a sudden rise in pressure. If this should happen, the operator can immediately shut down the entire operation.

After a cementing operation is completed, the mandrel 35 is returned to the open position (illustrated in FIG. 2) before another job is commenced. To return the mandrel to open position, the operator first closes the valve controlling flow to line 42, and opens another valve (not shown) which regulates flow into line 43. This allows the hydraulic fluid to flow into chamber 36 through port 41 and push downwardly against the top face of the mandrel shoulder 35*a*. The amount of fluid pressure applied is sufficient to move the mandrel downwardly far enough for the top of the mandrel to be clear of the outlet port 45, as described earlier.

As mandrel 35 moves upwardly to its closed position, and downwardly to its open position, residual hydraulic fluid will accumulate in chamber 36 both above and below shoulder 35*a*. When the mandrel moves upwardly, as shown in FIG. 2, the hydraulic fluid above the shoulder will be pushed back into the inlet line 43. Conversely, when the mandrel moves downwardly, as shown in FIG. 2, the hydraulic fluid below the shoulder will be pushed back into the inlet line 42.

The invention claimed is:

1. A cementing head apparatus for injecting a cementing plug into a well casing, the apparatus comprising:

a head unit including a plug housing, a baffle member secured inside the plug housing, a cementing plug assembly mounted in the baffle member and retained by a shear means;

the plug housing having a first fluid inlet port located above the baffle member, and a second fluid inlet port located below the cementing plug assembly;

the plug housing including a coupling means adapted for connecting the well casing into the head unit;

a manifold unit including an upper manifold housing, and a lower manifold housing coupled to the upper manifold housing;

the upper manifold housing having a first fluid outlet port adapted for coupling into the first fluid inlet port, and a second fluid outlet port adapted for coupling into the second fluid inlet port;

a tubular mandrel having an outside shoulder thereon, the mandrel being positioned inside the upper and lower manifold housings, and the mandrel being slidable to a closed position, which closes off the second fluid outlet port, and to an open position, which opens the second fluid outlet port;

an annular chamber being defined between the outside wall of the mandrel and the lower manifold housing;

the annular chamber having first and second fluid inlet ports, in communication with a source of fluid, the fluid providing means for moving the mandrel between its open and closed positions; and the lower manifold housing being adapted for connection into a cement pumper apparatus.

2. The cementing head of claim 1 in which the cementing plug assembly is defined by a stem cap including a threaded stem, and a cementing plug fastened to said threaded stem, and the shear means is defined by an O-ring placed between the stem cap and the baffle member.

3. The cementing head of claim 1 in which the mandrel is moved to its closed position by directing fluid through the first inlet port in the annular chamber, so that the fluid strikes the bottom face of the mandrel shoulder.

4. The cementing head of claim 1 in which the mandrel is moved to its open position by directing fluid through the second inlet port in the annular chamber, so that the fluid strikes the top face of the mandrel shoulder.

5. The cementing head of claim 1 in which the well casing is connected into the plug housing with a cap member which threads onto the plug housing, and which encloses the top end of the well casing, the connection including a first wedge ring which seats against the upper end of the well casing and the plug housing, and a second wedge ring, the second ring seating against the first wedge ring, the upper end of the well casing, and a retainer member positioned inside the cap member.

6. The cementing head of claim 1 in which the lower manifold housing has at least one sight port therein, and the tubular mandrel has a first indicator mark thereon which is visible through the sight port when the mandrel is in its closed position.

7. The cementing head of claim 6 in which the tubular mandrel has a second indicator mark thereon which is visible through the sight port when the mandrel is in its open position.

8. Method for injecting a cementing plug into a well casing, comprising the steps of:

positioning a cementing plug in the plug housing of a cementing head unit, said plug being retained in the plug housing by a shear means;

connecting the plug housing into a well casing the connection being made below the cementing plug;

simultaneously pumping a cement slurry into the plug housing above the cementing plug, and into the plug housing and the well casing below the cementing plug, at a constant flow rate, to thereby cause an equal pressure force in the plug housing above and below the cementing plug;

allowing a pre-determined amount of the cement slurry to be pumped into the well casing;

stopping flow of the cement slurry into the plug housing both above and below the cementing plug;

pumping a stream of fluid into the plug housing above the cementing plug under a pressure sufficient to rupture the shear means; and continuing to pump said fluid stream above the cementing plug at the same pressure, to cause the cementing plug to follow the cement slurry into the well casing.

* * * * *